US005954254A

United States Patent [19]

Maeng

[11] Patent Number: 5,954,254

[45] Date of Patent: Sep. 21, 1999

[54] CARRIER BELT FOR GOLF BAG

[76] Inventor: Seop Maeng, 903-7 Gorim-RI Yongin-EUP,Yonging-Kun Kyungkido, Seoul, Rep. of Korea

[21] Appl. No.: 08/942,400

[22] Filed: Oct. 1, 1997

Related U.S. Application Data

[63] Continuation-in-part of application No. 08/918,684, Aug. 21, 1997.

[30] Foreign Application Priority Data

Oct. 2, 1996 [KR] Rep. of Korea ..... 96-32552
Nov. 11, 1996 [KR] Rep. of Korea ..... 96-39304

[51] Int. Cl.[6] ..... A45F 3/04; A63B 55/00

[52] U.S. Cl. ..... 224/645; 224/627; 224/259; 206/315.3

[58] Field of Search ..... 224/627, 645, 224/259; 206/315.3

[56] References Cited

U.S. PATENT DOCUMENTS 191,027 5/1877 Case et al. .
D. 362,752 10/1995 Steurer .
950,452 2/1910 Montgomery .
990,837 5/1911 Carlson .
1,570,500 1/1926 Kennedy .
1,607,275 11/1926 Hettrick .
2,224,568 12/1940 Altorfer .
2,435,921 2/1948 Cronrath .
2,707,009 4/1955 Cook .
2,715,989 8/1955 Sjodin et al. .
2,820,498 1/1958 Endee .
2,853,111 9/1958 Williams .
2,864,361 12/1958 Johnson .
3,957,183 5/1976 Gadberry .
4,049,164 9/1977 Sullivan .
4,089,447 5/1978 Achmetell .
4,095,726 6/1978 Hechler, IV et al. .
4,318,502 3/1982 Lowe .
4,431,121 2/1984 Bensette .
4,487,347 12/1984 Zegar .
4,561,578 12/1985 Bell .
4,630,763 12/1986 Friedman .
4,688,643 8/1987 Carter et al. .
4,911,347 3/1990 Wilhite .
4,953,768 9/1990 Muse .
4,982,883 1/1991 Ullal et al. .
5,016,797 5/1991 Rowledge .
5,038,984 8/1991 Izzo .
5,042,703 8/1991 Izzo .
5,042,704 8/1991 Izzo .
5,184,764 2/1993 Orovan .
5,348,205 9/1994 Steurer ..... 224/645
5,540,365 7/1996 LaMair .
5,558,259 9/1996 Izzo .
5,636,778 6/1997 Jones et al. .

*Primary Examiner*—Linda J. Sholl
*Attorney, Agent, or Firm*—Chapman and Cutler

[57] ABSTRACT

A carrier belt is connected to a golf bag having a bag body with a longitudinal axis and a closed end and an open end. The carrier strap includes a fixing strap having a predetermined length with a first end attached to the bag body near the open end and a second end attached to the bag body at an intermediate position between the open end and the closed end. The fixing strap is elongated, flexible and substantially parallel to the longitudinal axis of the bag body. A pair of shoulder straps attached to the fixing strap provide a pair of loops which enable a user to position one shoulder of the user in one loop and the other shoulder of the user in the other loop. The shoulder straps are attached to the fixing strap so that the loops are oriented in a plane which is generally at a right angle with respect to the longitudinal axis of the bag body and adjustable along the predetermined length of the fixing strap to accommodate the physique of the user. The fixing strap may also be used as a handle enabling the user to grasp it with one hand when carrying the bag at different positions along the fixing strap's length according to the weight of the bag to achieve balance.

16 Claims, 6 Drawing Sheets

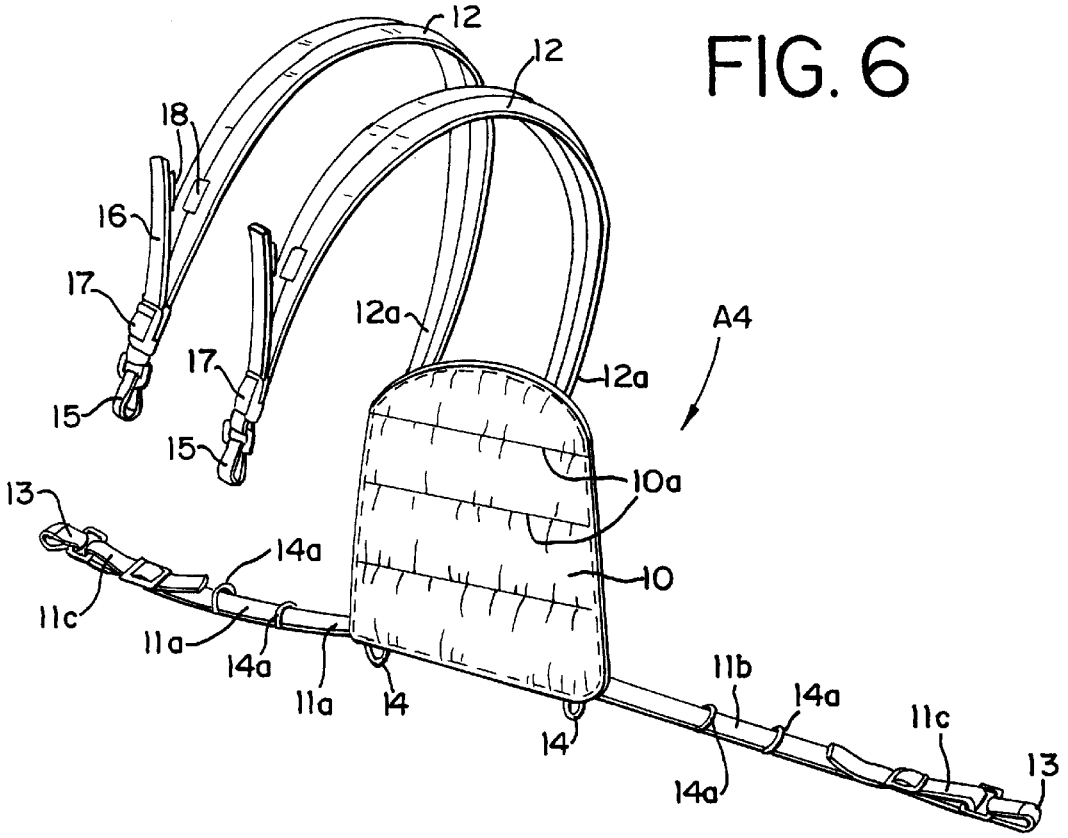
FIG. 6
FIG. 7
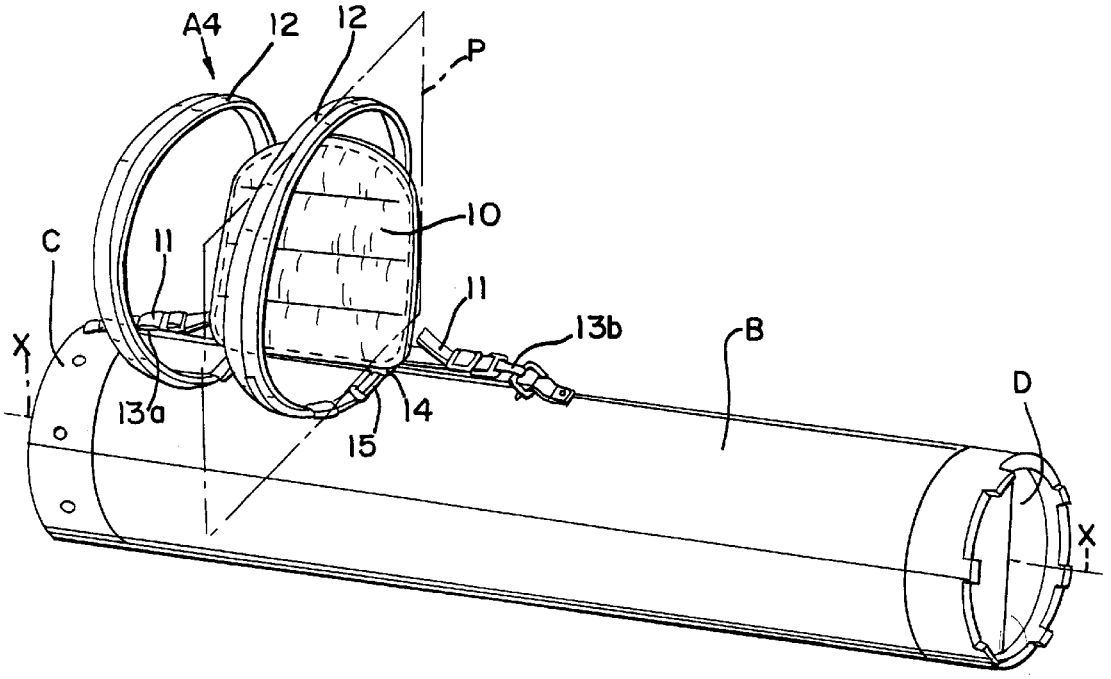

CARRIER BELT FOR GOLF BAG

RELATED PATENT APPLICATIONS

This application is a continuation-in-part application of U.S. Ser. No. 08/918,684, entitled "Carrier Belt For Golf Bag," filed Aug. 21, 1997. This related application is incorporated herein by reference and made a part of this application.

BACKGROUND OF THE INVENTION

1. Field of the Invention

The present invention relates to a carrier belt and handle for a golf bag. More particularly, it relates to a carrier belt for a golf bag in which shoulder straps are fixed to a mid-portion of a fixing strap attached between to an open end and an intermediate position between the closed end of the golf bag and the open end of the golf bag. The straps are disposed in a plane which is generally at a right angle to the longitudinal axis of the golf bag, thereby enabling the golf bag to more easily and comfortably carried and providing a carrier belt structure which is simple to manufacture. The fixing strap, attached at only two spaced points along the side of the bag body, may be used as a handle that allows the user to grasp it with one hand any where along its length to balance the golf bag.

2. Description of the Prior Art

Conventionally, a carrier belt for the golf bag having a single strap structure has been used by a golfer or caddy to carry the golf bag. The single strap has one end attached near an open end of the golf bag and its other end attached to a mid-portion of the golf bag. The strap is hung on one shoulder of the user. However, there are several problems with the conventional carrier belt. For example, the single strap carrier belt has a structure for supporting the golf bag with only one shoulder of the user. Accordingly, since the golf bag has a weight of about 5 kg–10 kg with golf clubs inserted into the bag, when carrying the golf bag on one shoulder, the golfer may experience shoulder pain, thus making carrying the golf bag very laborious. Moreover, since the single carrier belt tends to shift off the shoulder of the user, the use of the carrier belt becomes even more difficult. To solve the above problems, a dual strap structure has been proposed. The control of the length of the carrier belt and the shape of the loops in these dual strap structures is not, however, convenient. That is, it is difficult to modify the dual strap carrier belt configuration in accordance with the physique of the user. And it especially isn't very easy to position comfortably the loops of the conventional dual strap belt on the shoulders of the user. Also, the fixing clips for attaching the carrier belt to the golf bag frequently hit the back of the user, so the user experiences discomfort when using such a carrier belt for a long time.

SUMMARY OF THE INVENTION

One objective of the present invention is to solve the above problems and provide a carrier belt for a golf bag in which fixing clips, connectors, or other items causing discomfort, do not directly contact with the user's body, for example, the back of the user. Consequently, the carrier belt of the present invention can be comfortably used for long times. Moreover, since each of the shoulder straps is designed to be oriented in essentially a constant angle or position, namely, in a plane which is generally at a right angle to the longitudinal axis of the golf bag, the shoulder straps are very comfortable to, and easy to sling on and off the shoulders of, the user. The carrier belt of this invention is also simple to manufacture.

Another objective of the present invention is to provide a flexible bridge or fixing strap which also serves as an elongated handle that extends between only two connection points along the body of the golf bag. One connection point is near the open end of the bag body and the other connection point is near the center of the bag body. The advantage of such structure is twofold: First, it serves to transfer the weight of the bag approximately equally to each shoulder, when shoulder straps are slung over the two shoulders of the user, one strap on each shoulder. Second, the user may not wish to sling the golf bag across both shoulders, but simply grasp the fixing strap with one hand at any position along the length of the fixing strap which best balances the bag. Since the center of gravity of the golf bag varies depending on the number of golf clubs and accessories in the bag, this strap enables the user to adjust his or her hand position along the fixing strap as required to achieve balance under differing weights of the bag.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include convenience of use, ease of movement of the golf bag and ability to sling the bag over both shoulders of the user, simplicity and lower cost manufacture, and comfort of the user during carrying of the golf bag.

A first feature of the carrier belt of the present invention is that it is used with a conventional golf bag having a bag body with a longitudinal axis and a closed end and an open end. This feature includes a fixing strap having a predetermined length with a first end attached to the bag body near the open end and a second end attached to the bag body at an intermediate position between the open end and the closed end. Preferably, the fixing strap is flexible, being made of conventional cloth web material to which clips, rings, connectors, etc. may be easily sewn. When the fixing strap is attached to the bag body it is substantially parallel to the longitudinal axis of the bag body. In one configuration, the first end of the fixing strap attached to the bag body near the open end includes a first loop member which extends through a connector located near this open end. The second end of the fixing strap attached to the intermediate position includes a second loop member which extends through a connector located at the intermediate position. Each of these first and second loop members has a tip which is attached to a buckle element along the fixing strap.

A second feature is that the fixing strap is elongated to provide a unique handle structure. Except for the ends, the fixing strap is spaced from the bag body. This structure provides a member which allows the user with one hand to grasp the fixing strap at any one of several different positions along its length. The user may, therefore, adjust the position of his or her hand along the length of the fixing strap to balance the bag as required depending on the weight of the distribution of bag, which can vary as the number in clubs or accessories in the bag increases or decreases. Consequently, as the weight of the golf bag changes, the user now position his or her hand at the precise location to balance the bag so that it may be carried with one hand in the most convenient manner.

A third feature is a pair of shoulder straps attached to the fixing strap to provide a pair of loops which enable the user to position one of his or her shoulders in one loop and his or her other shoulder in each other loop. In accordance with this invention, the shoulder straps is attached to its fixing strap so that the loops is oriented in a plane which is generally at a right angle with respect to the longitudinal axis of the bag body. The straps are adjustable along the predetermined length of the fixing strap to accommodate the physique of each user. For example, the shoulder strap has a free end and there are a plurality of connector elements along the fixing strap which enable the user to detachably connect these free ends to the fixing strap in a spaced apart relationship. The other end of each shoulder strap is in a fixed position, fixedly connected either directly to the strap or indirectly by fixedly connecting it to a back panel which is attached to the fixing strap. Because different users have different physiques, the ability to adjust the distance between the free ends connected along the fixing strap insures that the connectors are off to the sides of the user rather than impinging directly against the user's back while carrying the golf bag using the carrier belt of this invention. The shoulder straps are made of a fabric which enables them to be easily attached to the fixing strap or back panel by sewing.

A fourth feature is the back panel. This back panel has a lower edge portion attached to the fixing strap, and each shoulder strap has one end fixedly attached to an upper edge portion of the back panel and a free end which is detachably connected along the fixing strap. Preferably, the back panel is adapted to be folded for storage. In the folded configuration, at least one hook and fabric fastener assists in maintaining the back panel in the folded state. Upon separation, the back panel may be unfolded. The back panel is preferably made of a cloth material. It is soft and enhances the comfort of the carrier belt of this invention. It also provides a large area on which to display advertising. For example, its area may range between approximately 25 and 100 square inches.

Advantageously, a strap and panel assembly is employed which comprises a back panel fixedly connected between a pair of spaced apart shoulder straps. This assembly may be fixedly connected to the fixing strap or it may be detachably connected to the fixing strap, enabling it to be selectively attached at different locations along the length of the fixing strap. Each shoulder strap has a distal end and a proximal end and the back panel has a bottom edge which has opposed terminal ends. Each one of these terminal ends is adjacent one of the proximal ends of the straps. The proximal ends are adapted to be detachably connected to the fixing strap if the assembly is to be detached and then reconnected to the fixing strap. Or, if not, these proximal ends are fixedly attached to the fixing strap. Each of the distal ends is free to be detachably connected to one or more positions along the fixing strap to provide a pair of loops which enable a user to position one shoulder of the user in one loop and the other shoulder of the user in the other loop.

There are several embodiments of this invention. In one, shoulder strap has one end fixedly attached at different, predetermined, spaced apart positions along the fixing strap. In a second embodiment, both fixed ends of the shoulder straps are attached to the fixing strap at essentially the same predetermined position. In a third, the shoulder straps cross and are connected together at the point of crossing. Opposite each fixed end is a free end to which is attached one element of a connector. Several other connector elements are spaced apart along the fixing strap to which the elements on the free ends are detachably connected to adjust loop size in accordance with the physique of the user. For example, some connectors are at essentially the same predetermined positions or points of attachment as each fixed end. Other connector elements are closer to the ends of the fixing strap and spaced from the connector elements that are at the same predetermined positions or points of attachment as the fixed ends.

Because of the use of fabric for the major components of the carrier belt, namely, the fixing strap, shoulder straps, and back panel, these components are simply sewn together. The design and construction of the carrier belt allow the belt to be folded to compact it for storage and shipment, and then attached to the body of the golf bag when desired.

BRIEF DESCRIPTION OF THE DRAWINGS

The preferred embodiments of this invention, illustrating all its features, will now be discussed in detail. These embodiments depict the novel and non-obvious carrier belt of this invention as shown in the accompanying drawings which are for illustrative purposes only. These drawings include the following figures (FIGS.), with like numerals indicating like parts:

FIG. 6 is a perspective view showing a carrier belt for a golf bag according to a fourth embodiment of the present invention, FIG. 7 is a perspective view the carrier belt of FIG. 6 attached to a golf bag;

DETAILED DESCRIPTION OF THE PREFERRED EMBODIMENTS

Figure 1:
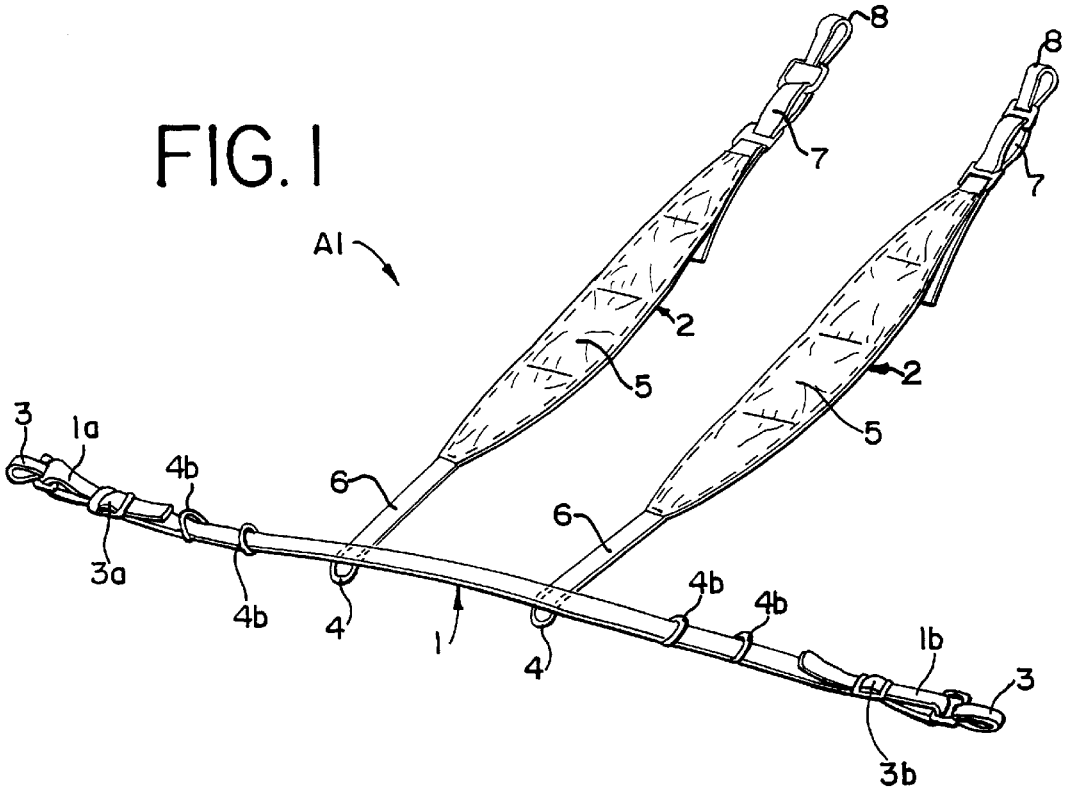
FIG. 1 is a perspective view showing a carrier belt for a golf bag according to a first embodiment of the present invention.
Figure 2:
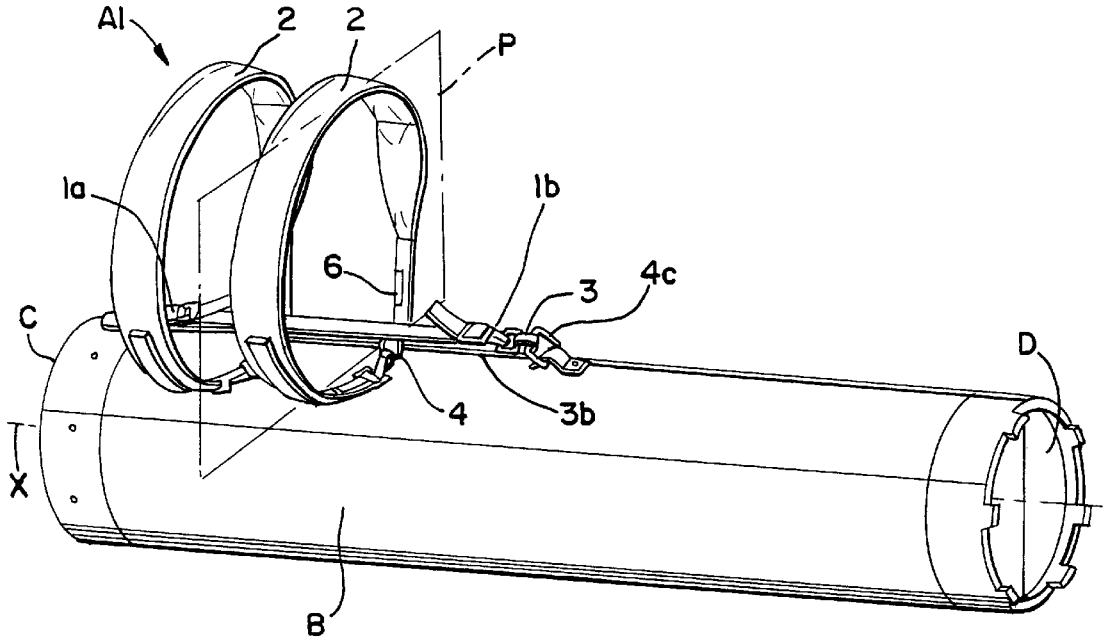
FIG. 2 is a perspective view showing the carrier belt of FIG. 1 attached to a golf bag.

As shown in FIGS. 1 and 2, a carrier belt A1 according to the first embodiment of the present invention is removably attached to a golf bag B. The carrier belt A1 includes a pair of shoulder straps 2, with each strap having one end fixedly attached to a central section of a flexible bridge or fixing strap 1 made, for example, of nylon woven web material. The other ends of the shoulder straps 2 are free and are adapted to be connected to the fixing strap 1 by fixing hooks 8 at the free ends that are detachably connected to fixing rings 4 or 4*b* as desired to accommodate the physique of the user to form a pair of loops as shown in FIG. 2. Each shoulder strap 2 includes a pad 5, a lower connection band 6 downwardly extending from the pad 5, and an upper connection band 7 upwardly extending from the pad 5. In this embodiment, the lower connection bands 6 of the shoulder straps 2 are at a right angle to the fixing strap 1, so the shoulder straps 2 are generally parallel to each other and disposed generally at a right angle to the fixing strap 1.

There are fixing connectors or hooks 3 attached to the opposed ends 1*a* and 1*b* of the fixing strap 1. The fixing hook 3 at the one end 1*a* of the fixing strap 1 is detachably connected near the open end C of the golf bag B and the other fixing hook 3 at the other end 1*b* of the fixing strap 1 is detachably connected to a central, intermediate position along the bag body between the open end C of the golf bag B and the lower or closed end D of the golf bag. The fixing strap 1 has an elongated band shape with buckles 3*b* along its length which permit the respective tips of the elongated band to be inserted into the buckles 3*a* and 3*b*, allowing the over all length of the fixing strap 1 to be adjusted as required.

Fixing rings 4 are attached to a central section of the fixing strap 1 and a plurality of fixing rings 4*b* are attached to outer portions of the fixing strap 1 and spaced at intervals along the length of the fixing strap 1. Fixing hooks 8 at the free ends of the straps are connected to the fixing rings 4 as shown in FIG. 2. In order to control the position of the shoulder straps 2 according to physical conditions of the user, that is, height, weight, shoulder width, and waist width, the additional fixing rings 4*b* are provided to allow for connection of the fixing hooks 8 to alternate positions along the length of the fixing strap 1. Thus, the distance between the connected free ends is adjustable as required by the user.

As depicted in FIG. 2, one fixing hook 3 attached to the end 1*a* of the fixing strap 1 is detachably connected to a square ring (not shown which is identical to square ring 4*c*) at the end C of the golf bag B. A second fixing hook 3 attached to the end 1*b* of the fixing strap 1 is detachably connected to a square ring 4*c* at an intermediate position along the body of the golf bag B. With the ends 1*a* and 1*b* of the fixing strap 1 so connected to the golf bag body, the fixing strap is spaced from the bag body a sufficient distance from the bag body to allow the user to grasp with one hand the fixing strap and use it as a handle. Because the fixing strap is flexible, it stretches under the weight of the golf bag slightly, providing clearance for the user's hand, and, because it is elongated having a length about equal to ½ the total length of the bag body, the user may grasp the fixing strap any where along its length as required to achieve balance when carrying the bag B with one hand.

After connecting the fixing strap 1 to the body of the golf bag B, the fixing hooks 8 of the shoulder straps 2 are detachably connected to the rings 4 or 4*b* as desired, to form loops into which the shoulders of the user are inserted during carrying of the golf bag B. Which of the fixing rings 4 or 4*b* are connected to the fixing hooks 8 determines the distance between the loops formed by the connected straps 2. Upon so connecting the free ends of the shoulder straps 2 to the fixing strap 1, the shoulder straps 2 are disposed in a plane P which is generally at a right angle with respect to the longitudinal axis X of the golf bag. Consequently, the user may easily and comfortably carry the bag A and the fixing hooks 8 are to the sides of the user instead of directly contacting the user's back.

Figure 3:
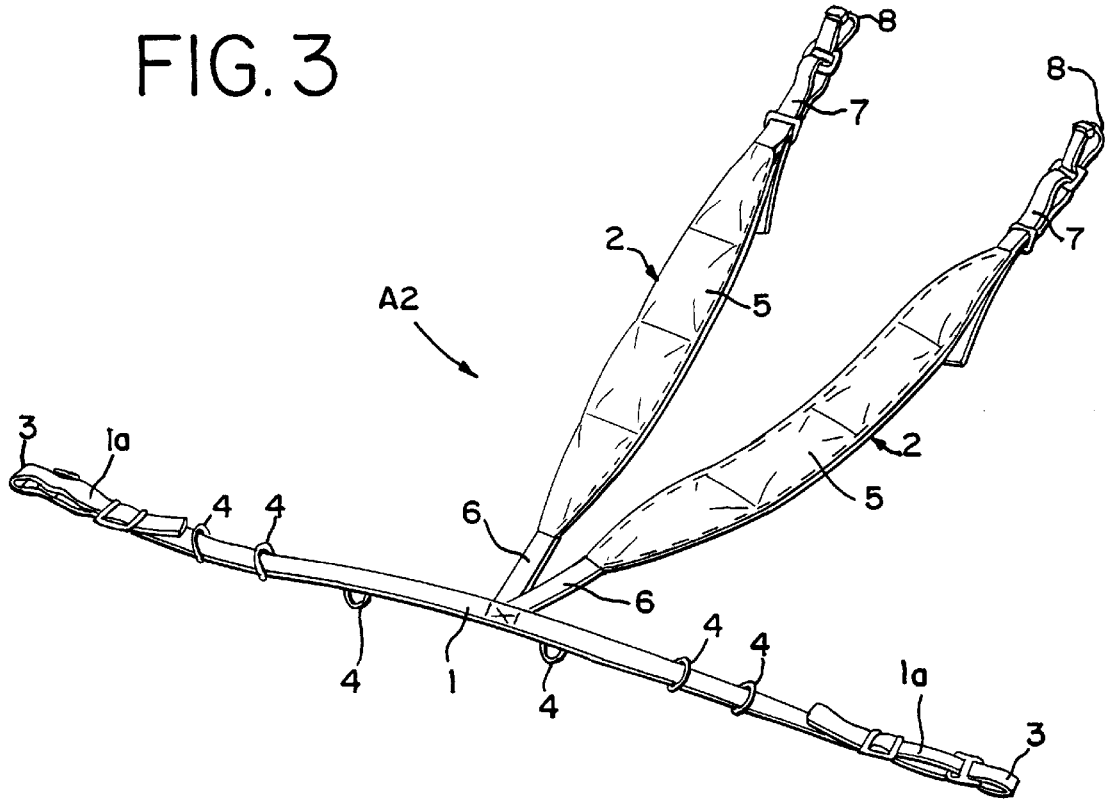
FIG. 3 is a perspective view showing a carrier belt for a golf bag according to a second embodiment of the present invention.

FIG. 3 shows a carrier belt A2 for a golf bag according to the second embodiment of the present invention. This second embodiment is similar to the first embodiment depicted in FIGS. 1 and 2, except the lower connection bands 6 of shoulder straps 2 are connected at essentially the same point of the fixing strap 1. This connecting point is approximately at the middle of the fixing strap 1. When the free ends of the straps 2 are connected by the fixing hooks 8 to the fixing rings 4 or 4*b*, the shoulder straps 2 are disposed in a plane which is generally at a right angle with respect to the longitudinal axis X of the golf bag. Consequently, the user may easily carry the bag A2 one or both shoulders.

Figure 4:
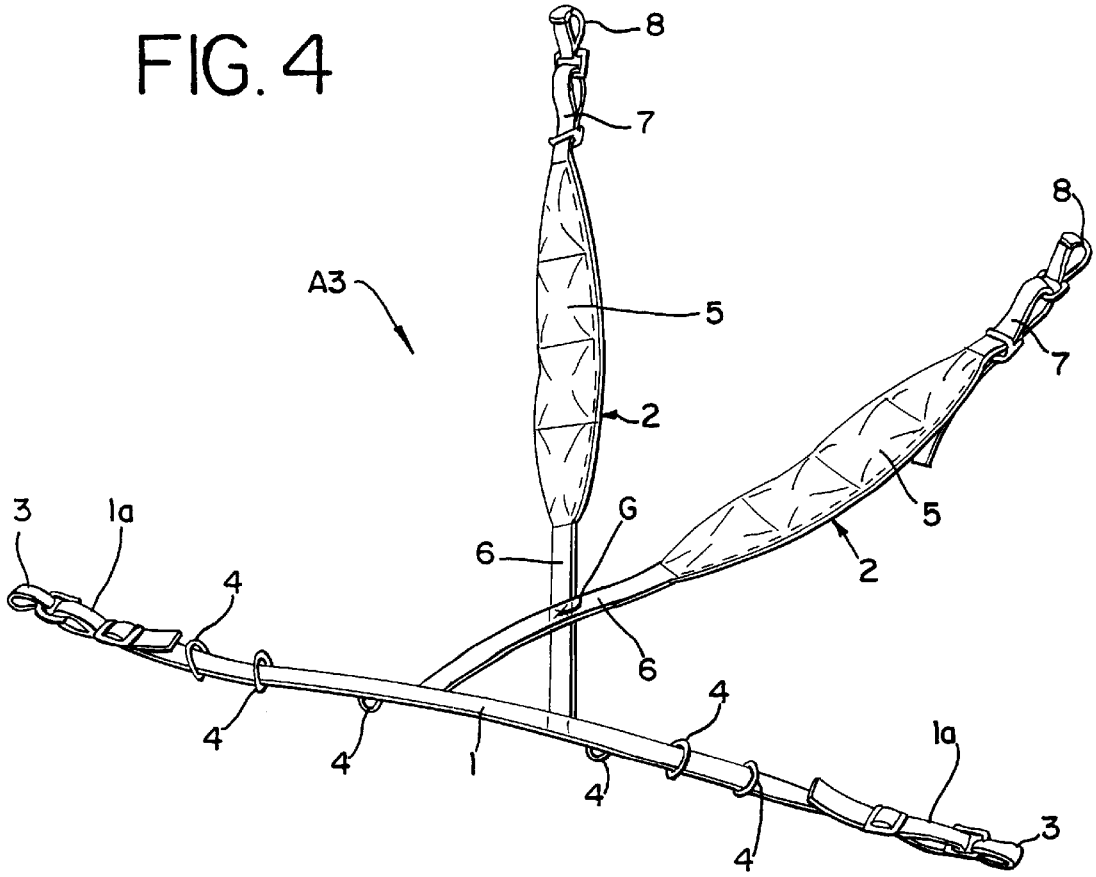
FIG. 4 is a perspective view showing a carrier belt for a golf bag according to a third embodiment of the present invention.
Figure 5:
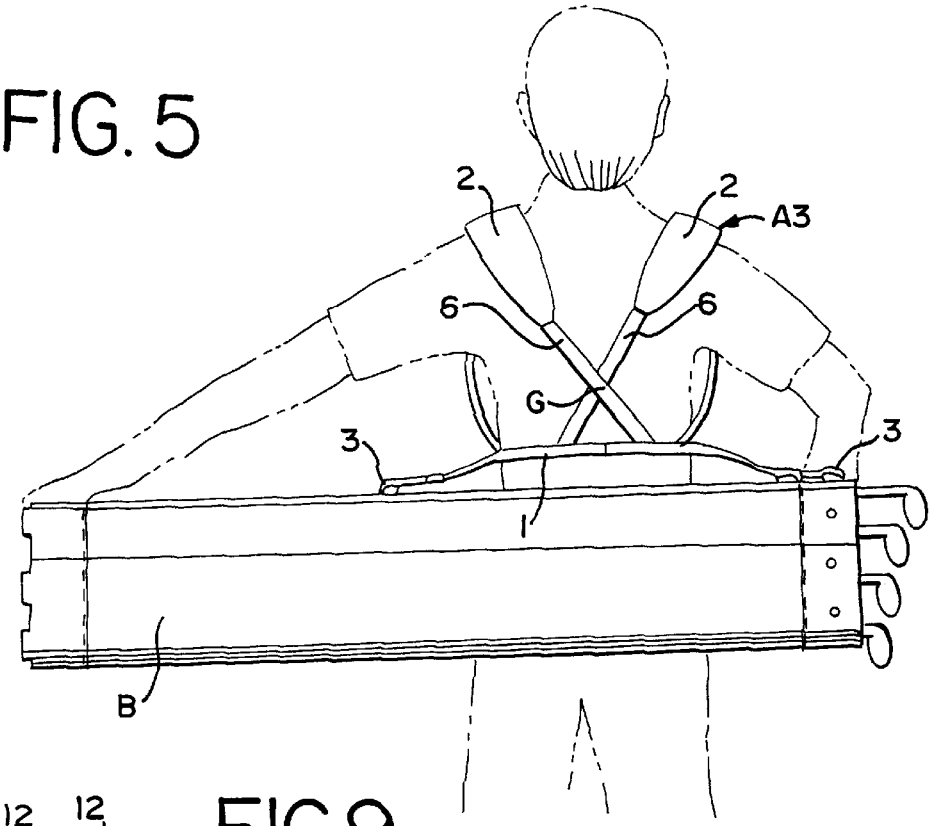
FIG. 5 is a rear plain view showing the carrier belt of FIG. 4 attached to a golf bag being carried by a golfer or caddy.

FIGS. 4 and 5 show a carrier belt A3 for a golf bag according to the third embodiment of the present invention. The lower connection bands 6 of the two shoulder straps 2 are crossed to form the straps into a shape like the letter X. The ends of the bands 6 are spaced apart and fixedly attached to the fixing strap 1 and these bands 6 are fixed to each other at a cross point G. The shoulder straps 2 maintain their shape without slipping towards the left or the right, and the weight of the golf bag is more uniformly distributed across the shoulders and back of the user. Consequently, the user may hang the golf bag B across his or her shoulders more conveniently and comfortably. As shown in FIG. 5, when a user wears the third embodiment of the present invention, the shoulder straps 2 are hung on both shoulders of the user, so the weight of the golf bag is distributed downward from the shoulders, with the bag body at a right angle with respect to the spine of the user, allowing the user to easily grasp each end of the golf bag with one hand to assist in lifting some of the load off the shoulders of the user. In this third embodiment, the X-shaped lower connection bands 6 may contact the back of the user.

Figure 9:
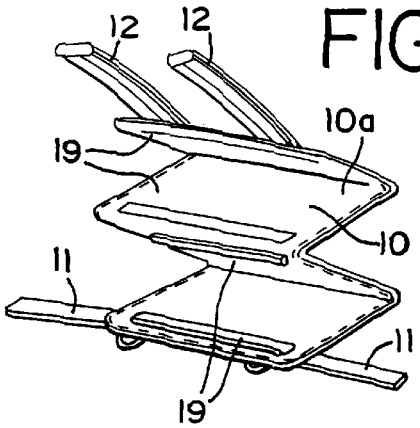
FIG. 9 is a perspective view showing the folding state of a back pad used in the of the fourth embodiment of the present invention.

FIG. 6 shows a carrier belt A4 for a golf bag according to a fourth embodiment of the present invention employing a substantially rectangular back panel 10. The back panel 10, preferably being padded, has a plurality of folding lines 10A in order to easily fold the panel 10, so a user can fold and store the carrier belt A4 when it is not in use. Although in this embodiment the shape of the back pad is shown as rectangular, it can be formed as a circle, an oval, or a triangle. FIG. 9 depicts a folding condition of the back panel 10 having hook and fabric connectors 19 in the form of strips as a means of holding the back panel 10 in a folded condition when storing the carrier belt A4. The Velcro Corporation makes suitable hook and eye connector strips 19. A plurality of connector strips 19 and folded lines 10A are formed on a back panel 10, so that the back panel can be folded along the folded lines 10A and bonded by the strips 19 in order to maintain the pad in the folded condition. Alternately, the back panel 10 may be simply rolled up for storage.

A fixing strap 11 is attached to a golf bag B in a manner similar to the other embodiments of this invention as discussed above. At each free end of shoulder straps 12 in this form is a fixing band 16 looped to hold a fixing hook 15. The length of each of the fixing bands 16 is controlled by a fixing clip 17, and a hook and eye connector 18 is attached to a surface of free tips of the fixing band 16 and a surface of the shoulder strap 12, respectively, in order to detachably connect the tips by these connectors 18.

One or two fixing straps 11 may be used at the lower edge of the back panel 10. When two fixing straps 11*a* and 11*b* are used, the inner ends of the fixing straps 11*a* and 11*b* are fixed to the left and right of the back panel 10, respectively, with the lower edge of the panel serving as the central portion of a fixing strap structure. Fixing hooks 13 are attached to the outer looped ends 11*c* of the fixing straps 11*a* and 11*b*, with one fixing hook 13 of the fixing strap 11*a* detachably connected near the open end C of a golf bag B and the other fixing hook 13 of the fixing strap 11*b* detachably connected to the intermediate position near the closed end D of the golf bag B.

In this forth embodiment, the shoulder straps 12 have free ends, and opposed to these free ends, fixed ends 12*a* are attached to an upper edge of the back panel 10. As discussed above, the lower edge of the back panel 10 is fixedly attached between the fixing straps 11*a* and 11*b*. A pair of fixing rings 14 are attached to the lower edge of the back panel 10 (that is, along the fixing strap structure). A plurality of additional fixing rings 14*a* spaced at constant intervals are attached to the fixing straps 11*a* and 11*b*. The fixing rings 14 and 14*a* are used to make appropriate adjustments in positions of the shoulder straps 12 according to the physique of the user, that is, height, weight, shoulder width, and waist width of the user, to adjust the spacing between of the loops formed when the free ends of the shoulder straps 12 are detachably connected to the fixing rings 14 or 14*a*, as the case may be, as depicted in FIG. 7.

Figure 8:
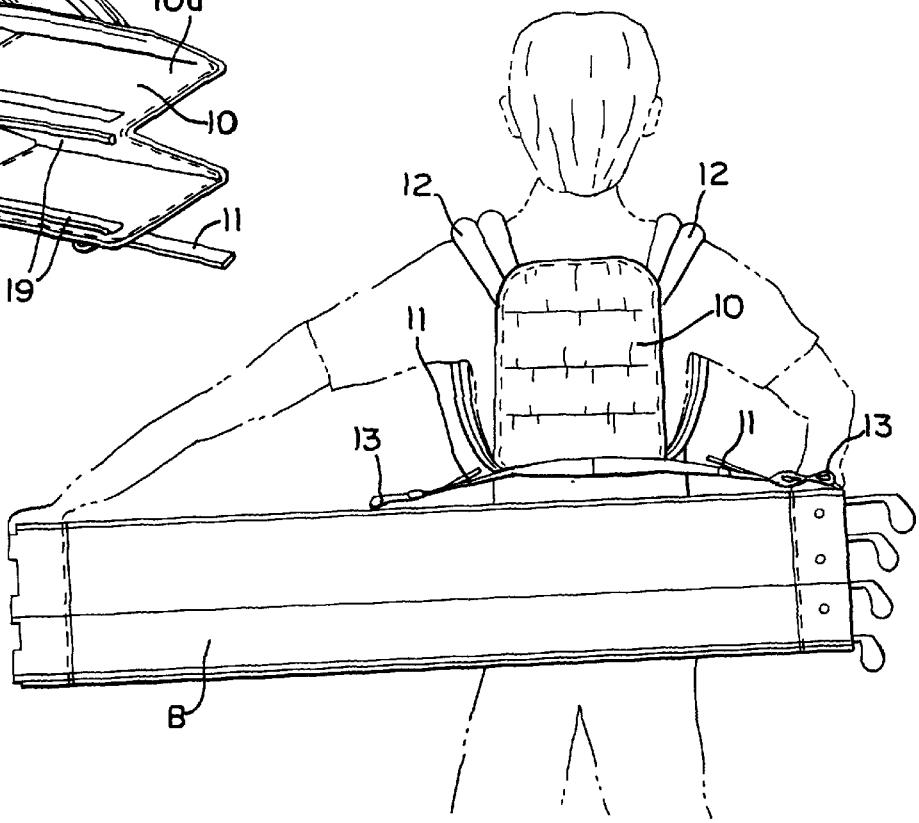
FIG. 8 is a rear plain view showing the carrier belt according to the fourth embodiment of the present invention attached to a golf bag being carried by a golfer or caddy.

As shown in FIG. 7, a fixing hook 13*a* fixed to the outer looped end of fixing strap 11*a* is attached near the open end C of the golf bag B, and the other fixing hook 13*b*, attached to the outer looped end of the fixing strap 11*b*, is fixed at an intermediate position on the body of the golf bag B. The fixing hooks 15 on the shoulder straps 12 of the carrier belt A4 are fixed, for example, to the fixing rings 14 attached to the lower edge of the back panel 10. A plane P formed as a loop by the shoulder strap 12 is disposed generally in a plane which is at a right angle to the longitudinal axis X of the golf bag, thereby enabling a user to comfortably wear the carrier belt A4. As illustrated in FIG. 8, the user wears the carrier belt A4 with the shoulder straps 12 hung on both shoulders, enabling the user to hold opposed ends of the golf bag B with ease. In this embodiment, most of the surface of the back panel 10 is contacted with a back of the user. The weight of the golf bag B is distributed downward from the shoulder, making carrying of the bag more comfortable. As discussed above, when carrying the golf bag B with one hand, the user grasps the fixing strap structure any where along its length as required to achieve balance for the weight of the bag.

Figure 10:
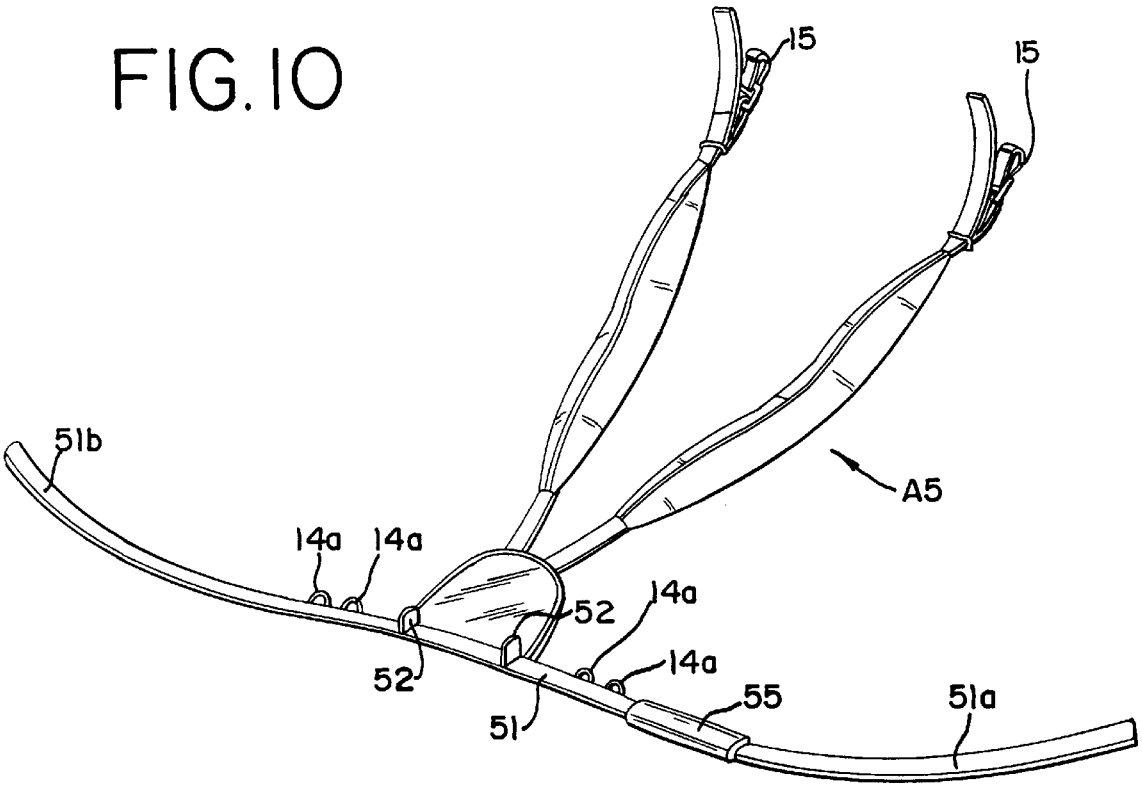
FIG. 10 is a perspective view showing a carrier belt according to a fifth embodiment of the present invention.
Figure 11:
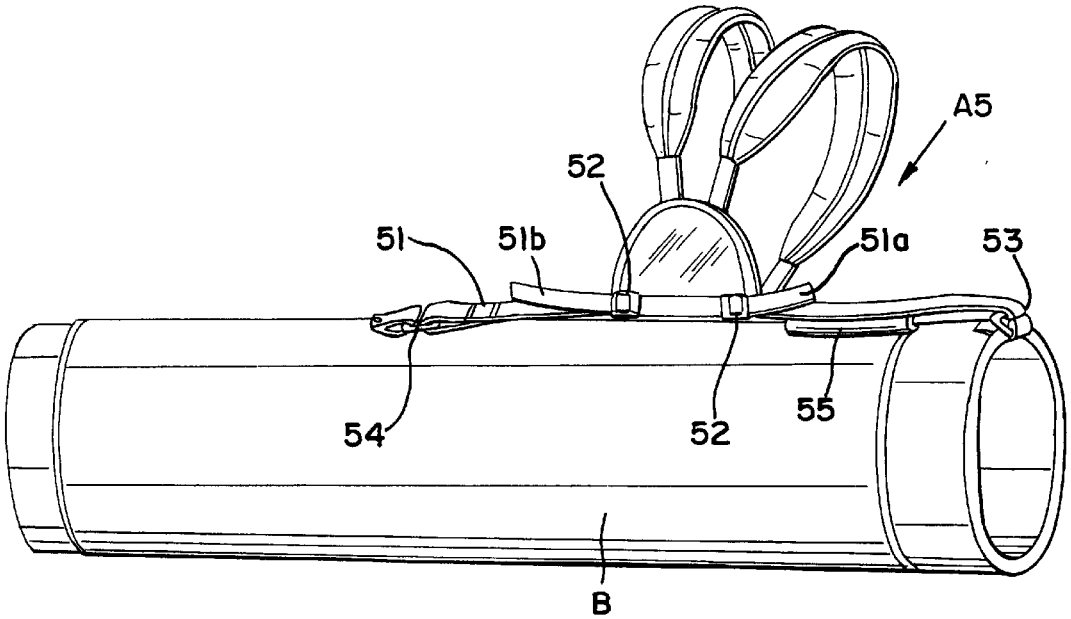
FIG. 11 is a perspective view showing use of a golf bag mounted of the carrier belt according to the fifth embodiment, attached to a golf bag.

Referring to FIGS. 10 and 11, a fifth embodiment carrier belt A5 employs buckles rather than fixing hooks to attach to the outer ends of a fixing strap 51 to the bag body. Two fixing buckles 52 are fixed to a mid-portion of the fixing strap 51. An outer end 51*a* of the fixing strap 51 is fixed to one fixing buckle 52, first passing through a fixing ring 53 mounted to near the open end of the golf bag B, and a lower end 51*b* of the fixing strap 51 is fixed to the other fixing buckle 52, first passing through a fixing ring 54 mounted to an intermediate position of the golf bag B. Accordingly, it is very easy to detachably mount the fixing strap 51 to the golf bag, regardless of the spacing distance between the fixing rings 53 and 54. As with the other embodiments, fixing rings 14*a* are used to detachably connect the fixing hooks 15 at the free ends of the shoulder straps to the fixing strap 51. A handle 55 is formed to the upper end 51*a* of the fixing strap 51. Thus, it is not necessary to mount a complicated structure handle to the golf bag. The user, however, need not grasp the fixing strap 51 by this handle, but may position his or her hand any where along the length of the fixing strap as required to achieve balance.

Figure 12:
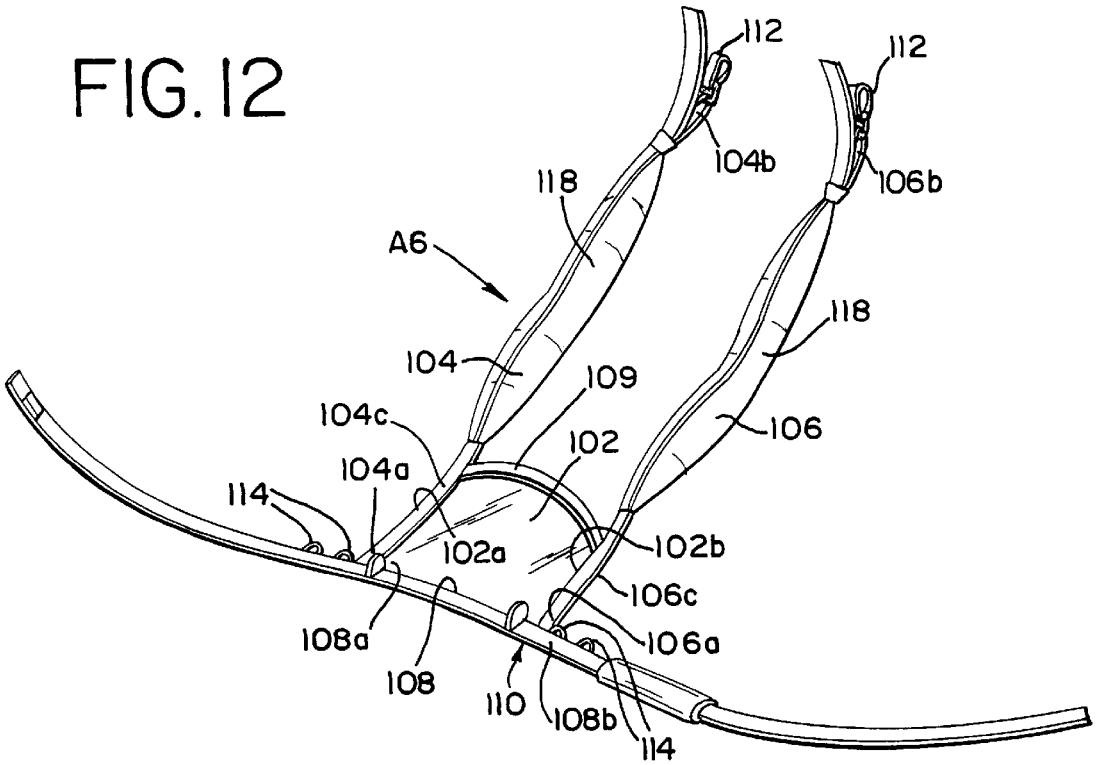
FIG. 12 is a perspective view of a sixth embodiment of this invention showing a carrier belt where shoulder straps are attached along each side of the back panel and the back panel is fixedly attached to the fixing strap.

Referring to FIG. 12, a sixth embodiment of this invention, a carrier belt A6 is depicted which includes a back panel 102 connected between a pair of flexible shoulder straps 104 and 106. Each strap 104 and 106, preferably made of fabric, has a padded middle portion 118, a proximal end 104*a*, 106*a*, and a distal end 104*b*, 106*b*. The proximal ends 104*a*, 106*a* are fixedly attached to a central portion of a flexible fixing strap 110, which is essentially the same as the fixing straps discussed above and used in the same manner for attachment to a golf bag.

The back panel 102 is generally rectangular in shape and has a width that is equal to the distance between the lower body sections 104*c* and 106*c*, respectively, of the straps 104 and 106. These lower body sections 104*c*, 106*c* are fixedly attached by sewing, respectively, to the opposed sides 102*a* and 102*b* of the back panel 102. A top edge 109 of the back panel 102 is just beneath the lower end of the padded middle portions 118, and the bottom edge 108 of the back panel is adjacent the central portion of the fixing strap 110. The bottom edge 108 has opposed terminal ends 108*a* and 108*b*, respectively, adjacent the proximal ends 104*a* and 106*a*. At least a potion of the bottom edge 108 is fixedly attached, preferably by sewing, to the central portion of the fixing strap 110.

The distal ends 104*b* and 106*b* each have fixing hooks or clips 112 attached thereto to enable these distal ends to be connected to one of several spaced apart fixing rings 114 along the length of the fixing strap 110. When these distal ends are connected to the fixing rings 114, loops are formed like those illustrated in FIG. 7 which are oriented in a plane that is generally at a right angle with respect to the longitudinal axis of the bag body. By selectively attaching the distal ends 104*b* and 106*b* to different fixing rings 114, the loops are adjustable to accommodate the physique of the user.

Figure 13:
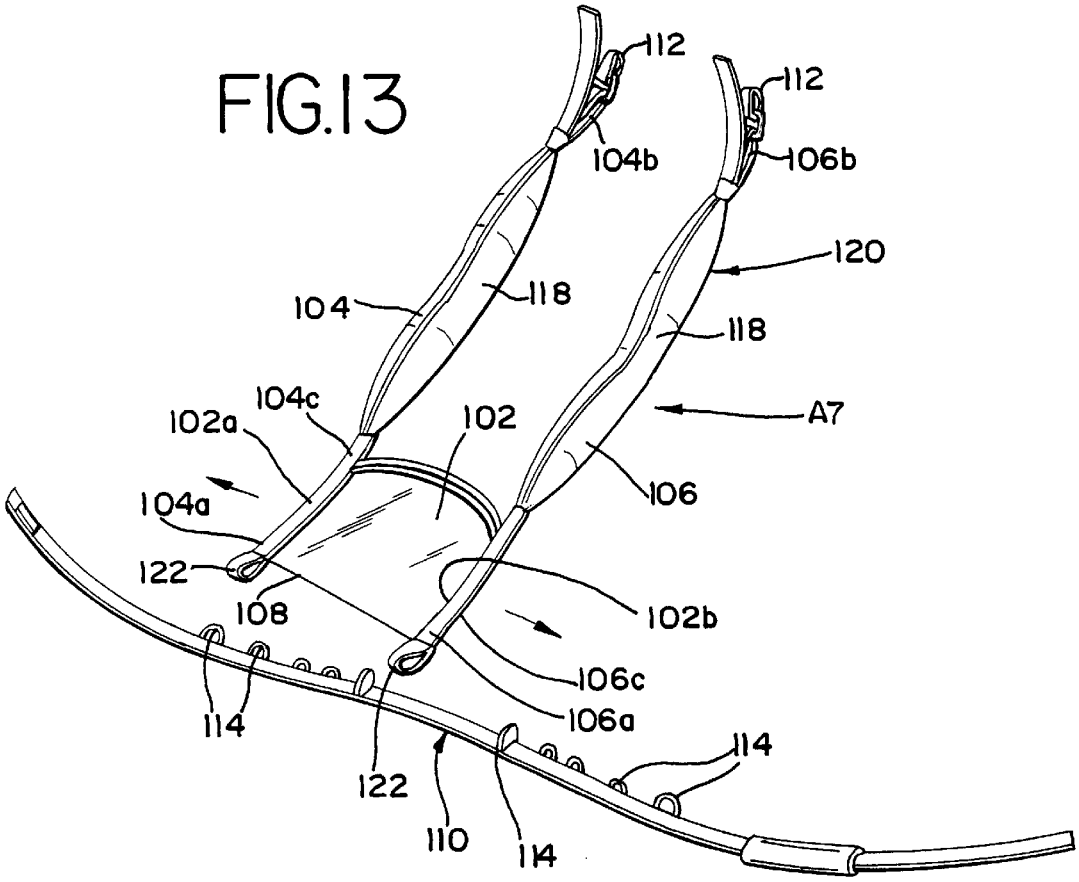
FIG. 13 is a perspective view of a seventh embodiment of this invention showing a carrier belt similar to that shown in FIG. 12, except that the assembly of the shoulder straps and back panel is detachably connected to the fixing strap.

FIG. 13 depicts a seventh embodiment of this invention. A carrier belt A7 is similar to the carrier belt A6 but is designed so that the assembly 120 of shoulder straps 104 and 106 and back panel 102 may be detached from the fixing strap 110 as illustrated. In this embodiment, the proximal ends 104*a* and 106*a*, respectively, of the straps 104 and 106 and the bottom edge 108 of the back panel 102 are not fixedly attached to the fixing strap 110. This enables the entire assembly 120 to be repositioned as desired along the length of the fixing strap 110. Fixing hooks 122 at the proximal ends 104*a* and 106*a* are detachably connected to selected fixing rings 114 as desired by the user to adjust the position of the assembly 120 along the length of the fixing strap 110.

The back panels 10 in the embodiments A4 and A5 and the back panels 102 in the embodiments A6 and A7 all serve to assist in maintaining the shoulder straps of these embodiments at a right angle with respect to the longitudional axis of the golf bag. In the embodiments A6 and A7, the fixing strap 110 to which the back panels 102 are attached is connected to the golf bag so that it is substantially parallel to the longitudinal axis of the bag body. In other words, the embodiments A6 and A7 are connected to the golf bag in the same way as the embodiments A4 and A5 are depicted, respectively, in FIGS. 7 and 11.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A golf bag, including a bag body having a longitudinal axis and a closed end and an open end, a fixing strap with a first end detachably connected to the bag body near the open end and a second end detachably connected to the bag body at an intermediate position of the bag body between the open end and the closed end, enabling said fixing strap to be detached from the bag body, said fixing strap being mounted substantially parallel to said longitudinal axis of the bag body, and first and second shoulder straps, each shoulder strap having a proximal end and a distal end, each of said proximal ends being fixedly secured to the fixing strap near a central portion of said fixing strap and located a predetermined distance spaced apart from the other proximal end to provide a space between said proximal ends, each of said distal ends being free to be detachably connected to one or more positions along the fixing strap to provide a pair of loops which enable a user to position one shoulder of the user in one loop and the other shoulder of the user in the other loop, said loops being oriented in a plane which is generally at a right angle with respect to the longitudinal axis of the bag body and adjustable to accommodate the physique of the user, and a back panel having a top edge, a bottom edge, and first and second opposed sides, with the back panel having a width substantially equal to said predetermined distance and located in the space between the proximal ends of said shoulder straps, a portion of the first shoulder strap being positioned along and fixedly attached to the first side of the back panel, and a portion of the second shoulder strap being positioned along and fixedly attached to the second side of the back panel.

2. The golf bag of claim 1 where said fixing strap is elongated and spaced from the bag body to provide a handle which may be grasped by the user with one hand at different positions along the length of the fixing strap.

3. The golf bag of claim 1 where the fixing strap is flexible.

4. The golf bag of claim 1 where there are a plurality of connector elements along said fixing strap which enable the user to detachably connect said distal ends of the shoulder straps to the fixing strap in a spaced apart relationship adjusted to the physique of the user.

5. The golf bag of claim 1 where the back panel is adjacent the central portion of fixing strap and at least a portion of said bottom edge of the back panel is fixedly secured to the central portion of said fixing strap.

6. A golf bag, including a bag body having a longitudinal axis and a closed end and an open end, a fixing strap with a first end detachably connected to the bag body near the open end and a second end detachably connected to the bag body at an intermediate position of the bag body between the open end and the closed end, enabling said fixing strap to be detached from the bag body, said fixing strap being mounted substantially parallel to said longitudinal axis of the bag body, and a strap and panel assembly comprising a back panel fixedly connected between a pair of spaced apart shoulder straps, each shoulder strap having a distal end and a proximal end and said back panel having a bottom edge which has opposed terminal ends, each one of said terminal ends being adjacent one of said proximal ends, and said proximal ends being adapted to be detachably connected to the fixing strap, each of said distal ends upon said proximal ends being connected to the fixing strap being free to be detachably connected to one or more positions along the fixing strap to provide a pair of loops which enable a user to position one shoulder of the user in one loop and the other shoulder of the user in the other loop, said loops being oriented in a plane which is generally at a right angle with respect to the longitudinal axis of the bag body and adjustable to accommodate the physique of the user.

7. The golf bag of claim 6 where said fixing strap is elongated and spaced from the bag body to provide a handle which may be grasped by the user with one hand at different positions along the length of the fixing strap.

8. The golf bag of claim 6 where the fixing strap is flexible.

9. The golf bag of claim 6 where there are a plurality of connector elements along said fixing strap which enable the user to detachably connect said distal ends of the shoulder straps to the fixing strap in a spaced apart relationship adjusted to the physique of the user.

10. A carrier belt adapted to be connected to a golf bag having a bag body with a longitudinal axis and a closed end and an open end, said carrier strap including a fixing strap with a first end adapted to be detachably connected to the bag body near the open end and a second end adapted to be detachably connected to the bag body at an intermediate position of the bag body between the open end and the closed end, enabling said fixing strap to be detached from the bag body, said fixing strap adapted to be mounted substantially parallel to said longitudinal axis of the bag body, and first and second shoulder straps, each shoulder strap having a proximal end and a distal end, each of said proximal ends being fixedly secured to the fixing strap near a central portion of said fixing strap and located a predetermined distance spaced apart from the other proximal end to provide a space between said proximal ends, each of said distal ends being free to be detachably connected to one or more positions along the fixing strap to provide a pair of loops which enable a user to position one shoulder of the user in one loop and the other shoulder of the user in the other loop, said loops being oriented in a plane which is generally at a right angle with respect to the longitudinal axis of the bag body and adjustable to accommodate the physique of the user, and a back panel having a top edge, a bottom edge, and first and second opposed sides, with the back panel having a width substantially equal to said predetermined distance and located in the space between the proximal ends of said shoulder straps, a portion of the first shoulder strap being positioned along and fixedly attached to the first side of the back panel, and a portion of the second shoulder strap being positioned along and fixedly attached to the second side of the back panel.

11. A carrier belt adapted to be connected to a golf bag having a bag body with a longitudinal axis and a closed end and an open end, said carrier strap including a fixing strap with a first end adapted to be detachably connected to the bag body near the open end and a second end adapted to be detachably connected to the bag body at an intermediate position of the bag body between the open end and the closed end, enabling said fixing strap to be detached from the bag body, said fixing strap adapted to be mounted substantially parallel to said longitudinal axis of the bag body, and a strap and panel assembly comprising a back panel fixedly connected between a pair of spaced apart shoulder straps, each shoulder strap having a distal end and a proximal end and said back panel having a bottom edge which has opposed terminal ends, each one of said terminal ends being adjacent one of said proximal ends, and said proximal ends being adapted to be detachably connected to the fixing strap wherein, each of said distal ends upon said proximal ends being connected to the fixing strap being free to be detachably connected to one or more positions along the fixing strap to provide a pair of loops which enable a user to position one shoulder of the user in one loop and the other shoulder of the user in the other loop, and upon attachment to the golf bag, said loops are oriented in a plane which is generally at a right angle with respect to the longitudinal axis of the bag body and adjustable to accommodate the physique of the user.

12. A golf bag, including a bag body having a longitudinal axis and a closed end and an open end, a fixing strap with a first end detachably connected to the bag body near the open end and a second end detachably connected to the bag body at an intermediate position of the bag body between the open end and the closed end, enabling said fixing strap to be detached from the bag body, said fixing strap being mounted substantially parallel to said longitudinal axis of the bag body, and a strap and panel assembly connected to the fixing strap, said strap and panel assembly comprising a back panel connected to a pair of spaced apart shoulder straps, each shoulder strap having a free end to be detachably connected to one or more positions along the fixing strap to provide a pair of loops which enable a user to position one shoulder of the user in one loop and the other shoulder of the user in the other loop, said loops being oriented in a plane which is generally at a right angle with respect to the longitudinal axis of the bag body and adjustable to accommodate the physique of the user.

13. The golf bag of claim 12 where said fixing strap is elongated and spaced from the bag body to provide a handle which may be grasped by the user with one hand at different positions along the length of the fixing strap.

14. The golf bag of claim 13 where strap and panel assembly is fixedly connected to the fixing strap.

15. The golf bag of claim 13 where strap and panel assembly is detachably connected to the fixing strap.

16. A carrier belt adapted to be connected to a golf bag having a bag body with a longitudinal axis and a closed end and an open end, said carrier strap including a fixing strap with a first end adapted to be detachably connected to the bag body near the open end and a second end adapted to be detachably connected to the bag body at an intermediate position of the bag body between the open end and the closed end, enabling said fixing strap to be attached to and detached from the bag body, said fixing strap adapted to be mounted substantially parallel to said longitudinal axis of the bag body, and a strap and panel assembly connected to the fixing strap, said strap and panel assembly comprising a back panel connected to a pair of spaced apart shoulder straps, each shoulder strap having a free end adapted to be detachably connected to one or more positions along the fixing strap to provide a pair of loops which enable a user to position one shoulder of the user in one loop and and the other shoulder of the user in the other loop, upon attachment of the carrier belt to the golf bag, said loops being oriented in a plane which is generally at a right angle with respect to the longitudinal axis of the bag body and adjustable to accommodate the physique of the user.

* * * * *